United States Patent [19]

Maute

[11] 3,949,241

[45] Apr. 6, 1976

[54] CONTROL APPARATUS FOR ELECTRICAL DEVICES

[76] Inventor: Charles J. Maute, 89 Hanover Road, Mountain Lakes, N.J. 07046

[22] Filed: May 15, 1974

[21] Appl. No.: 470,002

[52] U.S. Cl. ..... 307/141; 119/5; 315/360

[51] Int. Cl.[2] ..... H01H 7/00; H01H 43/00

[58] Field of Search ..... 338/116, 73, 74, 78; 315/360, 311, 291; 58/19 C; 119/5; 240/2 LC; 307/141

[56] References Cited

UNITED STATES PATENTS

| | | | |
|---|---|---|---|
| 777,116 | 12/1904 | Louis | 338/78 |
| 1,736,474 | 11/1929 | Williamson | 315/360 |
| 2,180,047 | 11/1939 | Griffin | 338/116 |
| 2,467,910 | 4/1949 | Reckard | 338/116 |
| 2,478,343 | 8/1949 | Trask | 315/360 |
| 2,843,111 | 7/1958 | Roll | 315/360 |

*Primary Examiner*—David Smith, Jr.

[57] ABSTRACT

The apparatus has a potentiometer electrically interpositioned between an inlet and an outlet for attenuating and increasing the level of electrical power conducted therebetween. The potentiometer has a depending control knob which is cyclically and repeatedly engaged by motordriven sectors. Accordingly, in a given time frame one sector turns the control knob gradually to provide progressively increasing electrical power. This sequence is followed by a quiescent period in which the increased power remains available. Next, another sector turns the control knob gradually to diminish and finally to cut off power. This diminution of power, too, occurs over a given time frame, and is followed by a quiescent period in which power remains cut off. Subsequently, and automatically, the gradual, power-increasing period follows. The apparatus has an especial utility for use with an aquarium, albeit not limited to such an application, for simulating the occurrence of sunrise and nightfall.

8 Claims, 8 Drawing Figures

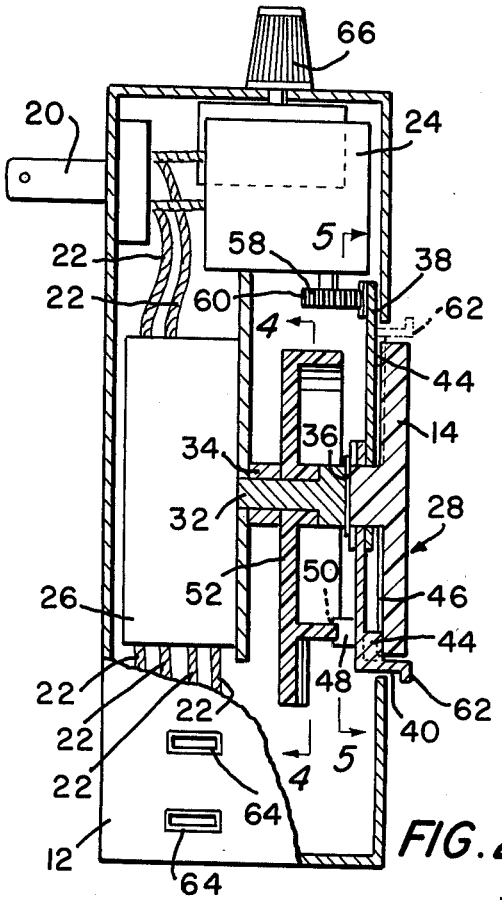
FIG. 2
FIG. 1
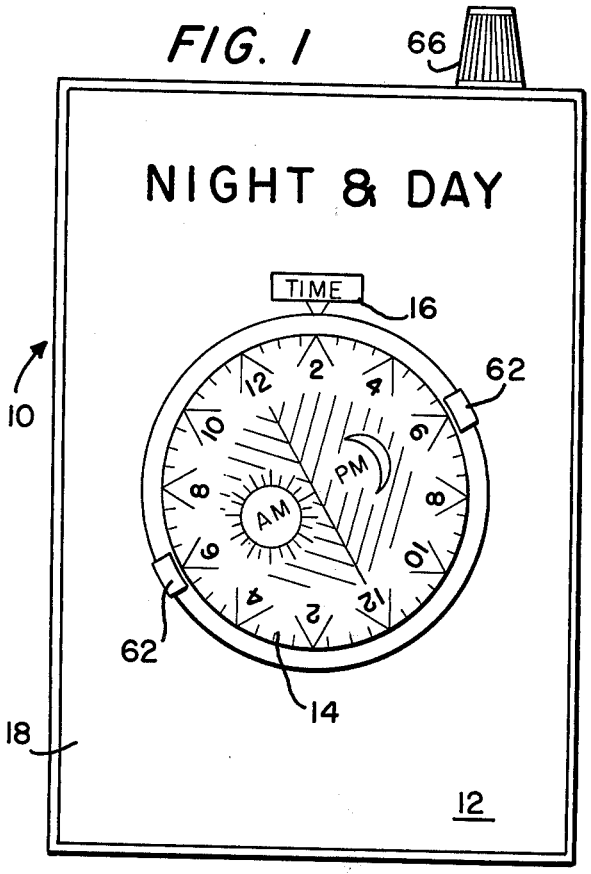
FIG. 4
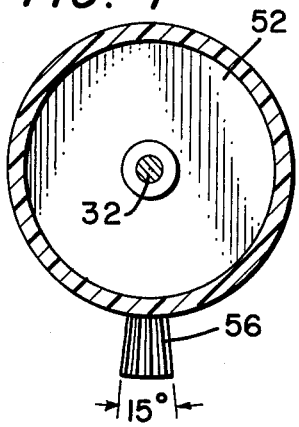
FIG. 5
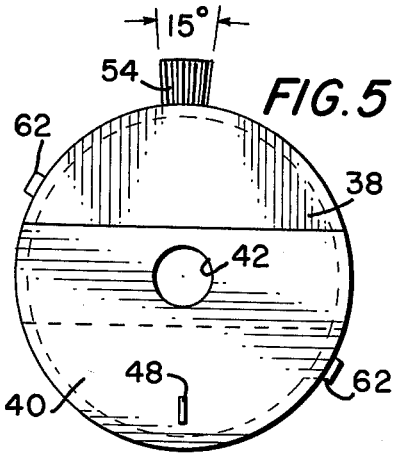
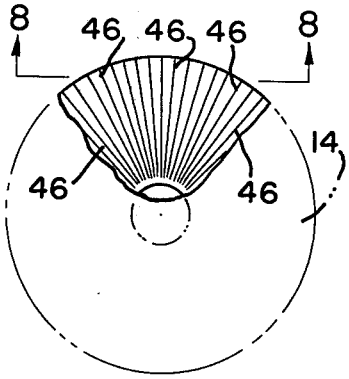
FIG. 7
FIG. 6
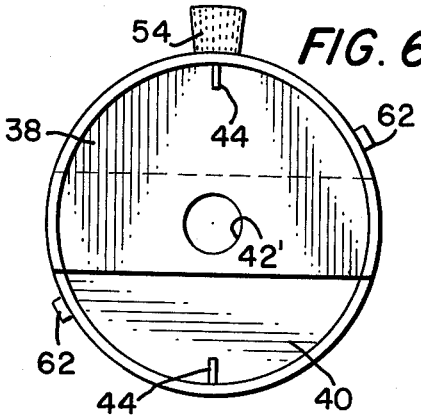
FIG. 3
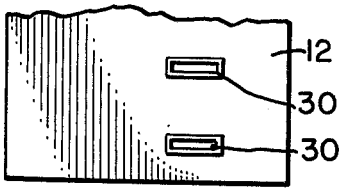
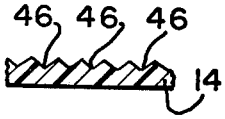
FIG. 8

CONTROL APPARATUS FOR ELECTRICAL DEVICES

This invention pertains to control apparatus for electrical devices, and in particular to such control devices capable of attentuating the electrical energy input to such devices, or increasing such input, or both.

In the prior art, control devices for electrical appliances, or whatever, are known which will respond to actuators to immediately turn on or off the appliance energy source or, as known from "mood lighting" components, will offer a manually-operative control knob for attenuating illumination. Further, according to U.S. Pat. No. 3,798,889, granted on 26 Mar. 1974, to Duane G. Chadwick, for "Artificial Sunrise," it is already known how to simulate sunrise; the latter reference is proposed as an annunciator, in an alarm system, to signal the commencement of the day.

In no known prior art, however, is it known how to devise an apparatus for controlling electrical devices wherein, automatically, electrical power is cycled from fully-on to fully-off modes, with intervening quiescent periods of whole power and no power. Yet, there is a present need for such apparatus, for a number of applications. For instance, in aquariums it is more conducive to the well-being of the aquatic life to simulate sunrise and nightfall, with light and darkness occurring over prolonged periods of time -- as the same occur naturally in nature -- than it is startingly to switch on full light or instantly to create complete darkness.

It is an object of this invention, then, to disclose an apparatus for meeting the need above-noted for aquariums, terrariums, vivariums, etc., which will simulate both sunrise and nightfall by offering a control for electrical devices -- lamps, heaters, etc., -- to diminish the illumination and warmth of "daylight," and to introduce such illumination and warmth (as naturally proceeds in nature), in a natural earth cycle.

Particularly, it is an object of this invention to set forth control apparatus for electrical devices comprising first means for passing electrical energy therethrough; said first means having inlet means for admitting electrical energy thereto, and outlet means for conducting electrical energy therefrom for energization of an electrical device; wherein said first means includes control means manipulative for attenuating and increasing electrical energy passed therethrough; and further including second means coupled to said control means and to said inlet means automatically manipulative of said control means to cause the latter to attenuate and increase the electrical energy, cyclically and repetitively, over separate time-spaced sequences of given durations.

A feature of this invention comprises the use of a potentiometer electrically interpositioned between an inlet and an outlet for attenuating and increasing the level of electrical power conducted therebetween. The potentiometer has a control knob which is cyclically and repeatedly engaged by motor-driven sectors. In a given time frame, one sector turns the control knob gradually and slowly to provide progressively increasing power. Sequentially, a quiescent period, in which the fully-increased power remains at its full level, follows. Thereafter, another sector turns the control knob in a contrary direction, gradually and slowly, to diminish and finally to cut off power. Here too, the power diminution occurs over a slow time frame and is followed by another quiescent period in which power remains cut off. Cyclically, then, the power-increasing time frame recurs.

Further objects and features of this invention will become more apparent by reference to the following description, taken in conjunction with the accompanying figures, in which:

FIG. 1 is a front elevational view of an embodiment of the invention, the same comprising, only by way of example, a control for aquarium lamps;

FIG. 2 is a side elevational view, taken from the left side of FIG. 1, of the control apparatus of FIG. 1, part of the housing being cut away, and inner components thereof being sectioned, for clarity of understanding;

FIG. 3 is a side elevational view of the lower portion of the apparatus of FIG. 1, the same being taken from the right side of FIG. 1;

FIG. 4 is a cross-sectional view, taken along section 4—4 of FIG. 1, of one of the rotary, actuator limbs;

FIG. 5 is a rear elevational view of the paired, juxtaposed, rotary actuator limbs, and FIG. 6 is a front elevational view of the same paired limbs;

FIG. 7 is a fragmentary rear elevational view of the timepiece dial; and

FIG. 8 is a cross-sectional view of the timepiece dial, taken along section 8—8 of FIG. 7.

As shown in FIG. 1, the novel apparatus 10 comprises a housing 12 which supports a timepiece dial 14 for roatation before a time-of-day indicator 16 inscribed on the cover 18 of the housing.

FIG. 2 depicts the mechanism of the apparatus, mounted within the housing (by means not shown), which enables the same. A male-plug connector 20, projecting from the housing, admits electrical power into the housing and, by means of wiring 22 conducts power to a potentiometer 24 and to an electrical motor 26. In cooperation with a time control mechanism 28, the motor 26 and potentiometer 24 operate to impart diminishing and increasing power to the electrical power female socket 30 (FIG. 3).

Motor 26 powers a rotation shaft 32, which carries a spacer 34, and rotatively drives the timepiece dial 14 through a clutch 36. In turn, the dial 14 imparts rotation to a pair of juxtapositioned, rotary limbs 38 and 40. Limbs 38 and 40 are shown in better depiction in FIGS. 5 and 6, the same being rear and front views thereof. The limbs 38 and 40 have shaft apertures 42 and 42' by means of which they are slidably and rotatively supported on shaft 32; each defines a little more than a half circle, and is surmounted or interfaced with the other thereof. On the forwardly-facing surfaces thereof, the limbs present keys 44 by means of which they are rotated. The timepiece dial 14, as shown in FIGS. 7 and 8, has a plurality of radially extending serrations 46 which, selectively, receive the keys 44 of limbs 38 and 40.

With rotation of the shaft 32, the same imparting rotation to dial 14 through clutch 36, the dial causes rotation of limbs 38 and 40. The dial rotation moves the keyways 46 in rotation and, in turn, the engagement of keys 44 with selected ones of the keyways or serrations 46 cause the limbs 38 and 40 to cycle. On the rear face of limb 40 is formed a key 48 which engages a keyway 50 formed in a limb 52; thus, limb 40 imparts rotary drive to limb 52. Now, limbs 38 and 52 have radially extending sectors 54 and 56 which are provisioned to operate potentiometer 24.

Potentiometer 24 has an operative knob 58 which has axially extending serrations 60 formed therein about the outside circumference thereof. The sectors 54 and 56 are also serrated, radially, for operative engagement with the serrations 60 of the potentiometer knob 58. Accordingly, as the sectors 54 and 56 move into engagement with the knob 58, the same cause the knob to turn -- thus controlling the amount of power available at socket 30.

Normally, the sectors 54 and 56 will be apart approximately one hundred and eighty degrees of arc, where the apparatus 10 is used to control illumination of an aquarium, for instance, to simulate sunrise and sunset. The sectors extend through some fifteen degrees of arc, accordingly, they engage the knob 58, in turn, for approximately one twenty-fourth of the cycle of the dial 14. Dial 14 has time-of-day indicia thereon, on the obverse face thereof, signifying the day's twenty-four hour duration, and motor 26 is an ultra-low rotation motor, making but one revolution of shaft 32 in a twenty-four hour period. Therefore, each sector 54 and 56 is operative of the potentiometer 24 for approximately 1 hour. During these discrete hours, one of the sectors turns the potentiometer to full power, and the other sector turns the potentiometer down to no power. Illumination devices, then, lamps or whatever, energized via socket 30 are turned off and on, over approximately one-hour sequences.

It is contemplated, of course, that the peripheral travel of the sectors 54 and 56, and the radius of the knob 58 are such as to insure a full down-turning and up-turning of the knob of effect a full diminution of power and full restoration of power.

Between the summer and winter soltices, of course, the natural durations darkness and light vary. So, to accommodate the apparatus 10 for these variations, the disclosure includes a facility for varying the power off and power on durations. The limbs 38 and 40 are flexible, the same being plastic in the depicted embodiment, and by disengaging the key 44 of either one thereof from its associated serration 46, it can be rotated to effect keying engagement with a different serration. Consequently, the limb sector 54 or 56 can be displaced into alignment with a more representative hour during which dawn or dusk does occur. Finger-tabs 62 are formed on peripheral edges of limbs 38 and 40 to facilitate this re-alignment. Keyway 50 of limb 52 is of sufficient depth to allow the manual displacement or flexing of limb 40 to allow key 44 to withdraw from a serration 46, and the same is true of limb 38 and its key 44 relative its serration 46 -- excepting for the uncommon circumstance when sector 54 is engaged with knob 58. In such latter circumstance, it is necessary first to rotate limb 38 past knob 58.

Clutch 36 is pressure-responsive; that is, in order to re-orient the dial 14 from an erroneous-indicated time of day to a corrected indication, it is necessary only to rotate the dial. The clutch 36 will accommodate for relative rotation between shaft 32 and the dial, if the dial is pressed inwardly toward the housing 12. On releasing manual pressure from the dial, the clutch will carry the dial in cycle in common with the shaft 32. The reason for this provisioning is to allow the user of the apparatus 10 to correct the indicated time-of-day dial reading for an actual time of day, if necessary. The keying earlier discussed will carry the limbs 52, 38 and 40 in rotation together with the dial 14 during such time-indicating correction.

As an ancillary facility, the apparatus offers a second power outlet 64 -- for powering an aquarium filter, or heater, or pump, or whatever, for examples -- which outlet is not subject to gradual diminution and increase of power. Outlet 64 is a normal outlet with a constant line voltage supply under the control of an on/off switch 66, the wiring 22 providing appropriate enabling circuitry.

As disclosed herein, the voltage-varying component is a potentiometer 24. Of course, a rheostat, variac, or the like could be used as well. Such components are readily available as, for instance, the Dimmer Controller component, Catalog No. 6204, of the Leviton Manufacturing Company of Brooklyn, New York.

Also, as described in connection with this embodiment of the invention, it is the interference interengagement of the knob serrations 60 with the like serrations formed in sectors 54 and 56 which causes the knob 58 to turn -- in one direction, at one time, and in the opposite direction at an ensuing time. Alternatively, the invention can be practiced by employing resilient materials on the interfacing surfaces of the knob and the sectors. The knob could carry a rubber-like sleeve and the sector surfaces could have a same rubber-like layer fixed thereon. It is an extremely low torque which is required to turn knob 58, thus other expedients for transmitting motion between the sectors 54 and 56 and the knob 58 will occur to those skilled in the art to which this invention pertains. Further, the apparatus 10 is depicted as a separate article for intercoupling between a line cord and an aquarium lamp plug, for instance. Now, this is exemplary, only. Through simple modification, quite within the ken of those skilled in the art, it is readily feasible to define an apparatus in accordance with the invention which is mountable onto an aquarium, terrarium, etc. Thus, while I have described my invention in connection with a specific embodiment thereof, it is to be clearly understood that this is done only by way of example, and not as a limitation to the scope of my invention as set forth in the objects thereof and in the appended claims.

I claim:

1. Control apparatus for continuous automatic control of illuminating means for a life environment such as an aquarium, terrarium or the like comprising:

first means for passing electrical energy therethrough, said first means having inlet means for admitting electrical energy thereto, and outlet means for conducting electrical energy therefrom for energization of said illuminating means for said light environment said first means including control means for cyclically and repetitively attenuating and increasing electrical energy passed therethrough, said control means of said first means comprising a potentiometer, said potentiometer having a voltage regulating control knob extending therefrom;

second means coupled to said control means and to said inlet means and cooperative with said control means so as to automatically manipulate said control means to cause said control means to attenuate and increase said electrical energy, cyclically and repetitively, over separate time spaced sequences of selected duration said second means comprising a motor means, said motor means having an output rotational shaft and actuator means, said actuator means comprising a limb means coupled to said output shaft of said motor means for rotation thereon, said limb means including radial elements disposed thereon for effecting contacting engagement with said voltage regulating control knob.

2. Control apparatus according to claim 1 wherein:

said voltage regulating control knob is rotatable in two directions;

said output rotational shaft is unidirectionally rotatable; and said actuator means is unidirectionally rotatable in cooperation with said output shaft and comprises means for rotating said voltage regulating control knob in said two directions.

3. Control apparatus, according to claim 1, wherein:

said control knob is rotatable in two directions, to attentuate electrical energy upon being rotated in one of said two directions, and to increase electrical energy upon being rotated in the other of said two directions, and said control knob has axially-disposed serrations formed in the outer surface thereof; and said radial elements have serrations formed in surfaces thereof for mating engagement with said control knob serrations to cause rotation of said control knob in response to rotation of said limb means.

4. Control apparatus, according to claim 3, wherein:

said output rotation shaft is disengageably coupled to a timepiece dial;

said dial having time indicia on the obverse face thereof and radially-extending recesses formed in the reverse face thereof, said recesses defining spaced-apart keyways; and said limb means having keys for selective engagement of said keys with given keyways;

said limb means being responsive to manually-effected displacement to disengage said keys from said keyways to accommodate rotary reorientation of said limb means relative to said shaft.

5. Control apparatus, according to claim 3, wherein:

said radial elements define minor segments of a circle.

6. Control apparatus, according to claim 4, wherein:

said indicia comprises graduations representative of twenty-four hours, said graduations being equally spaced apart; and said radial elements comprise circular segments each of which extends across a width substantially equal to the spacing obtaining between a pair of adjacent graduations.

7. Control apparatus, according to claim 3, wherein:

each of said radial elements defines a segment of a circle of between seven and a half and twenty-two and a half degrees of arc.

8. Control apparatus, according to claim 1, further including:

a housing; and wherein said first and second means are substantially enclosed in said housing;

said first means further includes an ancillary electrical outlet;

said ancillary outlet comprising a female elelctrical socket carried by said housing;

an electrical on/off switch mounted to said housing; and wiring circuitry electrically-interconnecting said inlet means, said electrical outlet, and said on/off switch.

* * * * *